US008056521B2

(12) United States Patent
Kreisig et al.

(10) Patent No.: US 8,056,521 B2
(45) Date of Patent: Nov. 15, 2011

(54) BEARING DEVICE

(75) Inventors: Michael Kreisig, Stuttgart (DE); Falk Schneider, Korntal-Munchingen (DE); Markus Walch, Bretten (DE)

(73) Assignee: Mahle International GmbH (DE)

( * ) Notice: Subject to any disclaimer, the term of this patent is extended or adjusted under 35 U.S.C. 154(b) by 446 days.

(21) Appl. No.: 12/346,098

(22) Filed: Dec. 30, 2008

(65) Prior Publication Data

US 2009/0165737 A1 Jul. 2, 2009

(30) Foreign Application Priority Data

Dec. 31, 2007 (DE) ..... 10 2007 063 255

(51) Int. Cl.
*F01M 1/06* (2006.01)

(52) U.S. Cl. ..... 123/90.34; 123/90.27; 123/90.31; 123/90.33; 123/90.6; 123/193.3

(58) Field of Classification Search ..... 123/90.6, 123/193.3, 193.5, 90.16, 90.27, 90.31, 90.33, 123/90.34; 29/888.1
See application file for complete search history.

(56) References Cited

U.S. PATENT DOCUMENTS 7,343,889 B2 * 3/2008 Tooyama et al. ..... 123/90.38
2005/0252470 A1 11/2005 Malek et al.

FOREIGN PATENT DOCUMENTS

DE 20120912 U1 11/2002
DE 10250303 5/2004
DE 10331089 2/2005
WO WO-2006/050545 5/2006

OTHER PUBLICATIONS

English abstract for DE-10331089.

* cited by examiner

*Primary Examiner* — Ching Chang
(74) *Attorney, Agent, or Firm* — Rader, Fishman & Grauer PLLC

(57) ABSTRACT

The present invention relates to a bearing device (1) for supporting a camshaft (2) in a cylinder head with at least two bearing blocks (3) which support the camshaft (2), and which are axially penetrated by the camshaft (2) to be supported in a first through-opening (6), and with a connection element (5), at which the at least two bearing blocks (3) are fastened in an aligned position, wherein the bearing blocks (3) together with the connection element (5) and the camshaft (2) form a prefabricatable module which is mountable in an aligned position at the cylinder head.

18 Claims, 5 Drawing Sheets

BEARING DEVICE

CROSS-REFERENCES TO RELATED APPLICATION

Figure 1:
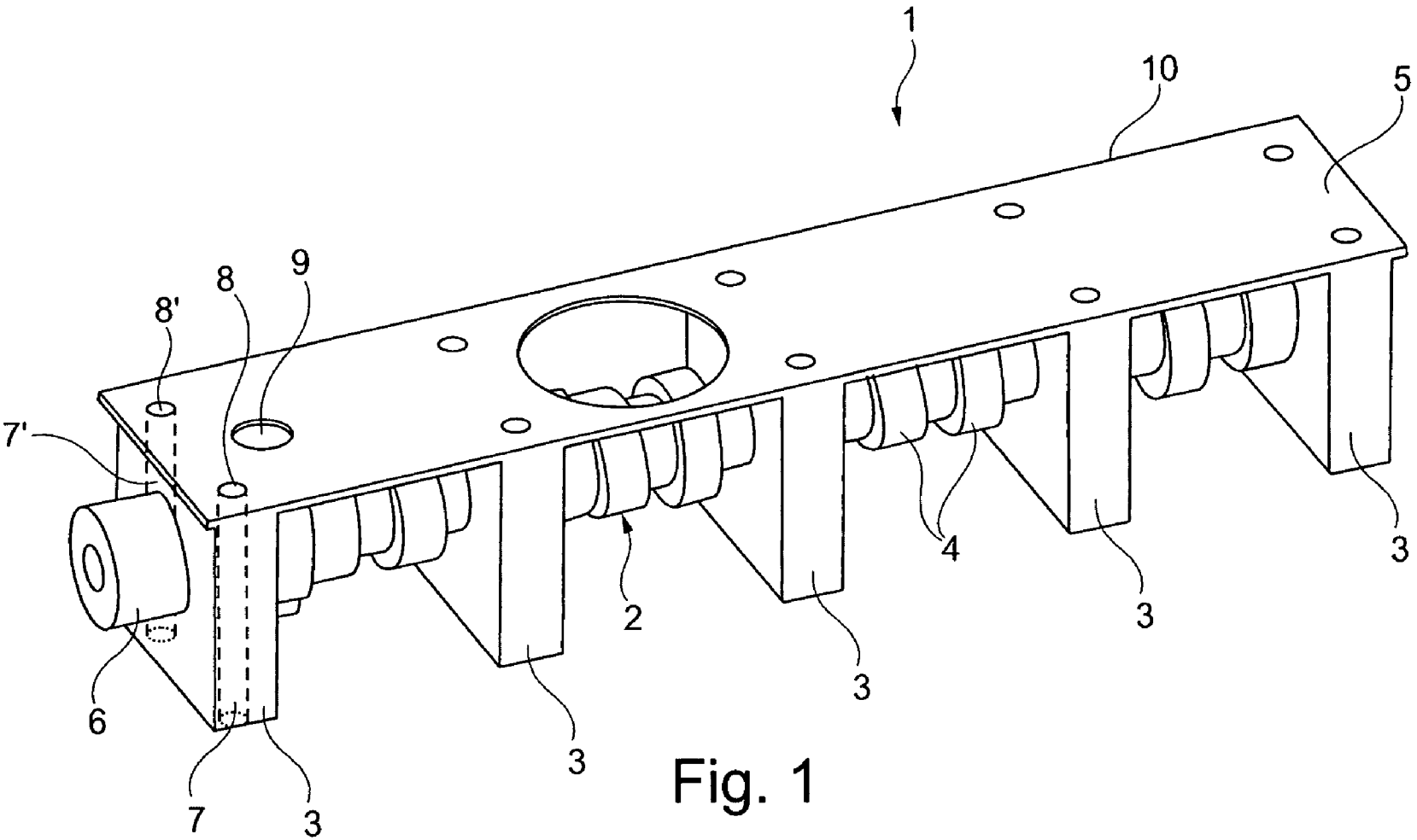

This application claims priority to German patent application DE 10 2007 063 255.1 filed Dec. 31, 2007, which is hereby incorporated by reference in its entirety.

The present invention relates to a bearing device for supporting a camshaft in a cylinder head. The invention relates further to an internal combustion engine equipped with such a bearing device.

In today's internal combustion engines, principally two different arrangements of a camshaft at a cylinder head have established themselves. In a first variant, the camshaft is received between the cylinder head and a so-called bearing frame onto which a cylinder head cover, which is mostly formed from plastic, is screwed with an adequate number of screws. Here, a bearing channel is formed by a half bearing shell in the cylinder head and in the bearing frame, respectively. The bearing channel must be machined, marked in the assembled state and subsequently disassembled again for mounting the camshaft. In contrast to this expenditure, however, there are a number of assembly advantages, for example, the cylinder head with the associated bearing frame and respectively aligned camshaft can be placed and screwed as one unit onto the cylinder block. In this case, the camshaft is already loaded with the forces of valve springs and is kept in position by the alignment, whereby an exact predefined position between crankshaft and camshaft is enabled. A second variant works without a bearing frame, that is, the cylinder head cover, which is, for example, made of aluminum die cast, is screwed directly onto the cylinder head. Thus, the second variant needs considerably less parts, whereby due to the cylinder head cover, which is typically made of metal, a higher sound emission is to be expected.

The present invention is concerned with the problem to provide a bearing device, which is in particular characterized by a simplified camshaft assembly at the cylinder head.

This problem is solved according to the invention by the subject matter of the independent claim 1. Advantageous embodiments are subject matter of the dependent sub-claims.

The invention is based on the general idea to form, as a prefabricated module, a bearing device fabricated from at least two bearing blocks, which support a camshaft and which are connected by a connection element, and to use it for the assembly of the camshaft at the cylinder head, and thereby to avoid in particular a subsequent machining of a bearing channel, and in particular a subsequent alignment of the bearing blocks. The camshaft is supported by the bearing blocks which are axially penetrated by the camshaft in a first through-opening. The bearing blocks are fixed to each other in an exactly aligned position so that the camshaft already supported in the bearing blocks can be prefabricated together with the bearing device, and mounted to the cylinder head as a prefabricated module. The module consisting of camshaft, bearing blocks and connection elements hereby forms an assembly aid. For producing the bearing device according to the invention, during fitting the cams onto the camshaft, the above mentioned bearing blocks are slid onto the camshaft in an adequate distance and are subsequently aligned with respect to the camshaft, and are fixed, in particular welded, to the connecting element. The unit of camshaft, bearing blocks and connection elements can hence be prefabricated, whereby the subsequent mounting of this unit into the cylinder head is kept very simple. Hereby, in particular a subsequent machining, for example grinding, of the individual bearing blocks after their attachment at the cylinder head is eliminated.

Preferably, the connection element is formed from metal and is welded to the bearing blocks. Here, as a connection element, a bending-resistant metal sheet can be used, the stiffness of which is so high that a bending, and, associated thereto, a bearing inaccuracy of the individual bearing blocks with respect to the camshaft can reliably be avoided. The welding between the bearing blocks and the connection element can be carried out via tacking points which are procedurally easy to produce, which at the same time ensure a safe and reliable fixation of the bearing blocks at the connection element.

Preferably, on at least one bearing block, at least one second through-opening is provided, which runs transverse to the first through-opening for the camshaft, and which is aligned with a third through-opening arranged in the connection element, and which is formed for passing through a screw, which fixes the bearing device and hence the camshaft at the cylinder head. The arrangement according to the invention of the different through-openings allows a simultaneous fixing of the connection element, the associated bearing block, and hence the camshaft at the cylinder head, with, compared to the prior art, few screws, whereby in particular the part variety, and hence the assembly effort, can be reduced substantially. A separate fastening of a bottom bearing shell and a top bearing shell associated with the therefore additionally required respective fasteners, and a subsequent reworking of the bearing shells with assembled camshaft hence can be eliminated.

In a further advantageous embodiment of the solution according to the invention, at the connection element, locking elements, and/or locking contours are provided through which the bearing device, together with the camshaft, can be fixed at a cylinder head cover. Such locking elements or locking contours, respectively, can be in the form of clip elements and can allow a simple clipping of the cylinder head cover onto the bearing device. Subsequently, the unit of cylinder head cover and bearing device including camshaft can easily be placed on the cylinder head and can be connected with, in particular screwed together with, the same by means of adequate fasteners. The clip engagement between the cylinder head cover and the bearing device makes in particular the positioning of the two components to each other and to the cylinder head easier, and thereby simplifies the assembly process. For a cylinder head cover formed from plastic, the locking elements can be molded in a simple manner with the injection molding method, that is, produced integral with the cylinder head cover. For this, the locking elements or the locking contours, respectively, are arranged at the bearing device or the cylinder head cover, respectively, such that a mounting of the bearing device on the cylinder head cover is possible only in an exactly predefined position, in which the subsequent mounting of the two components at the cylinder head is possible without problems.

In a further advantageous embodiment of the solution according to the invention, the connection element is structured at least double-layered, wherein a hollow space formed between the at least two layers of the connection element can serve as a lubrication channel or as a channel for running of electrical lines. Therefore, the connection element has not only the task to fix the individual bearing blocks in a pre-aligned position, thereby making the assembly of the camshaft easier, but has at the same time further tasks, such as, for example, the supply of lubrication to the individual bearing blocks, or a protected laying possibility for electrical lines, respectively. Such connection elements, which are composed of at least two individual layers, can easily be produced with respect to the manufacturing technology, and make a principally complex conduit in the region of the cylinder head unnecessary, if preferably many channels, for example lubrication channels, can be realized by means of respective hollow spaces formed between the individual layers of the connection element. By integration of further functions in the connection element, in particular complex assembly work for running of external lubrication lines or electrical lines, respectively, can be eliminated, whereby the manufacturing expenditure and hence the manufacturing cost can be reduced.

Further important features and advantages of the invention are apparent from the sub-claims, the drawings, and the associated description of the figures by means of the drawings.

It is to be understood that the above mentioned features, and the following features still to be described are not only usable in the respective mentioned combination but also in other combinations or on its own without departing from the scope of the present invention.

Preferred exemplary embodiments of the invention are illustrated in the drawings and are explained in more detail in the following description, wherein identical reference numbers are related to identical, or similar, or functionally identical components.

In the figures

Figure 2:
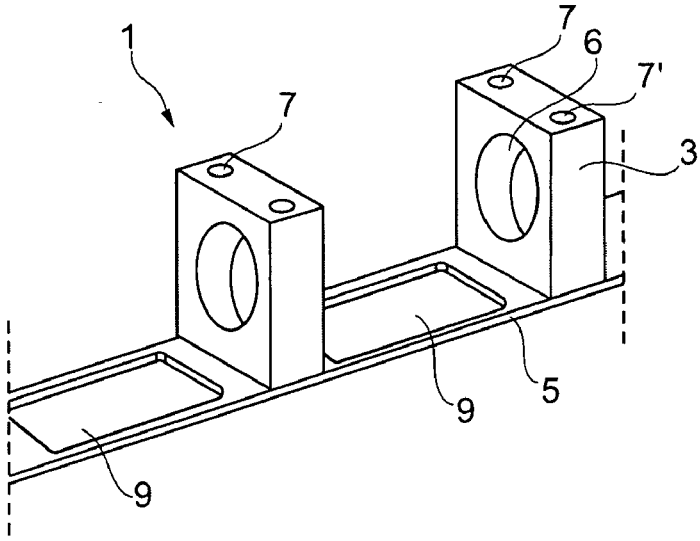
Figure 3:
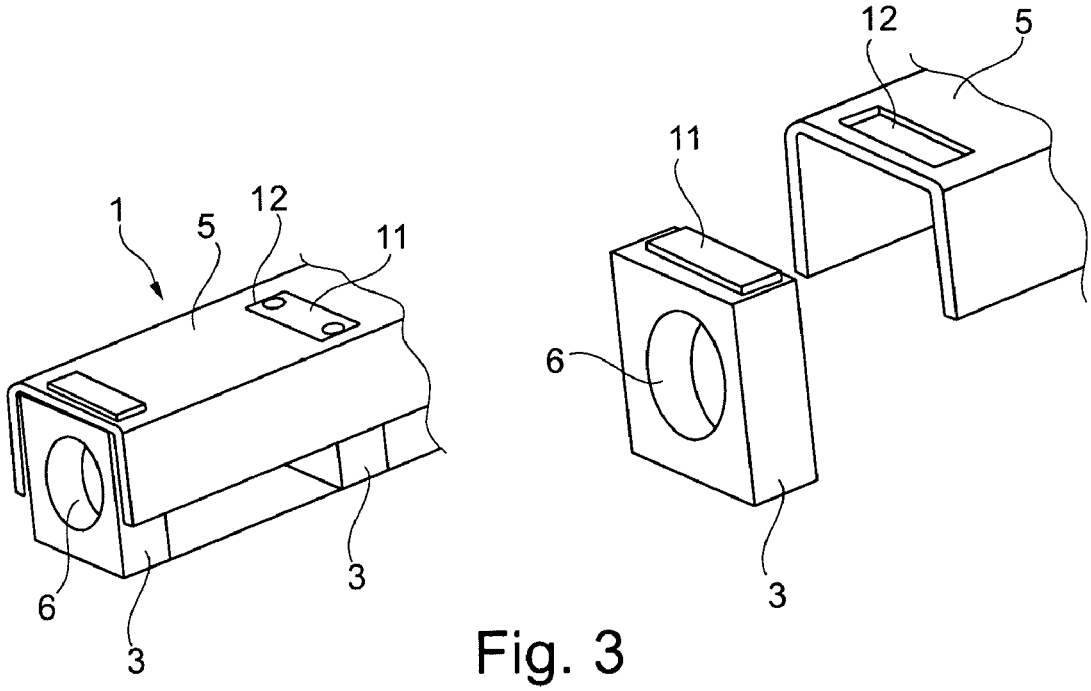
Figure 4:
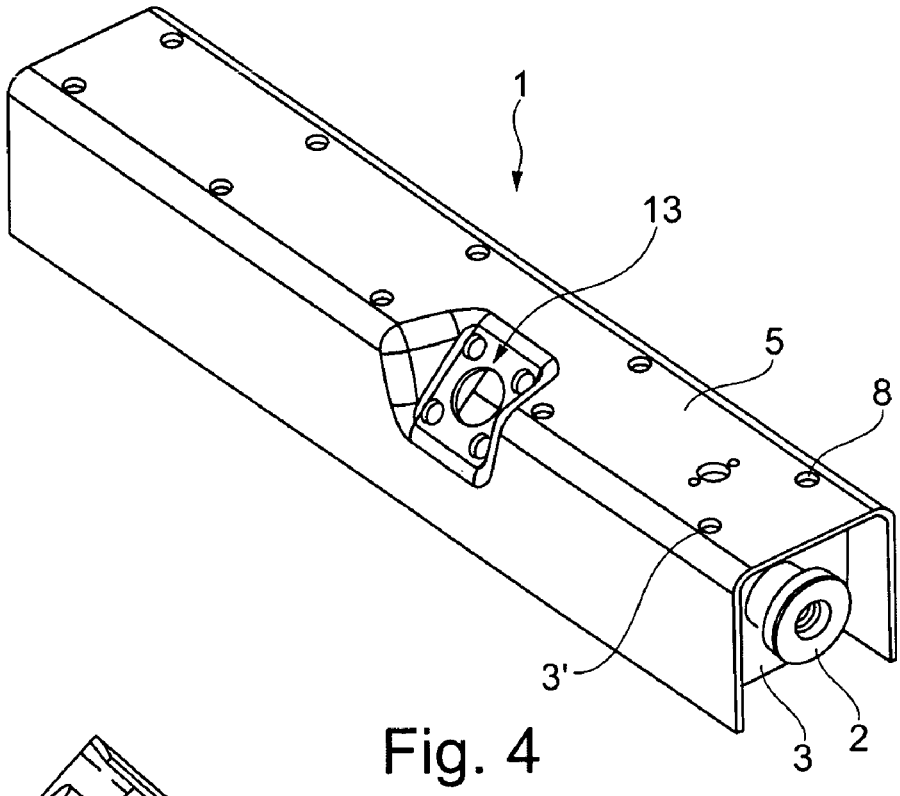
Figure 5:
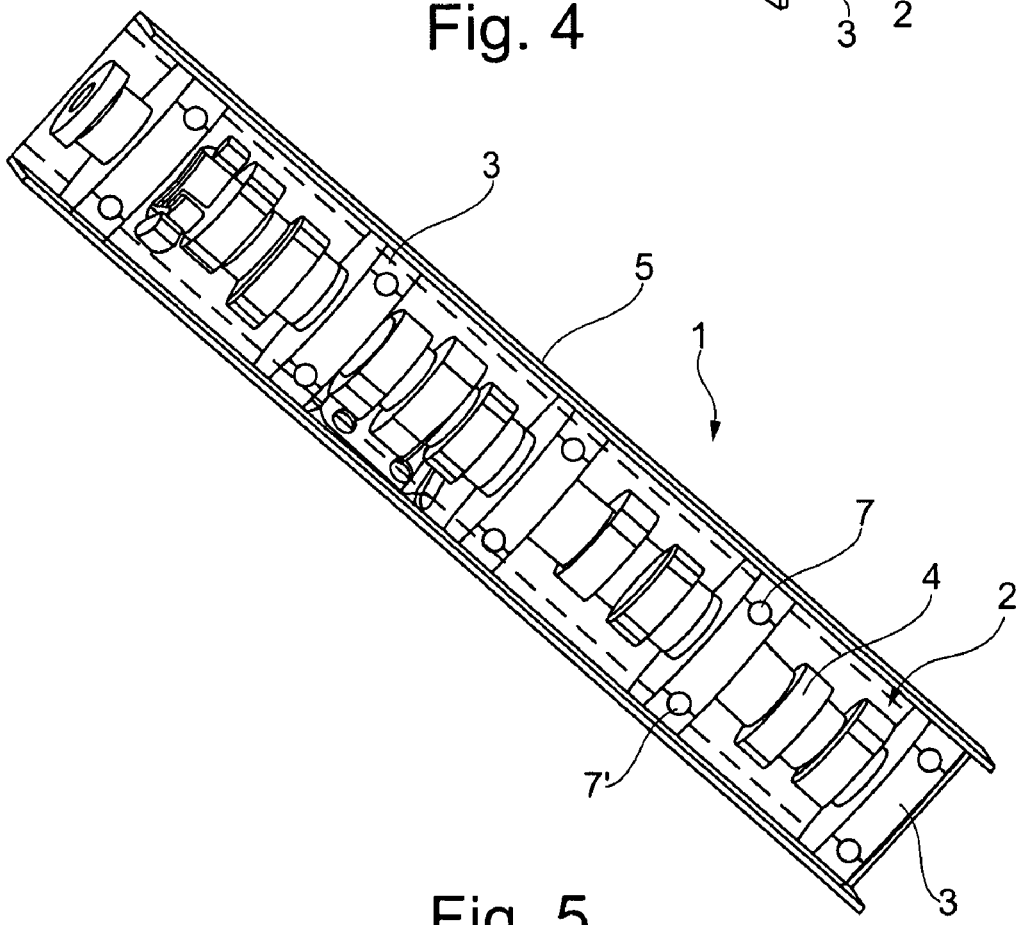
Figure 6:
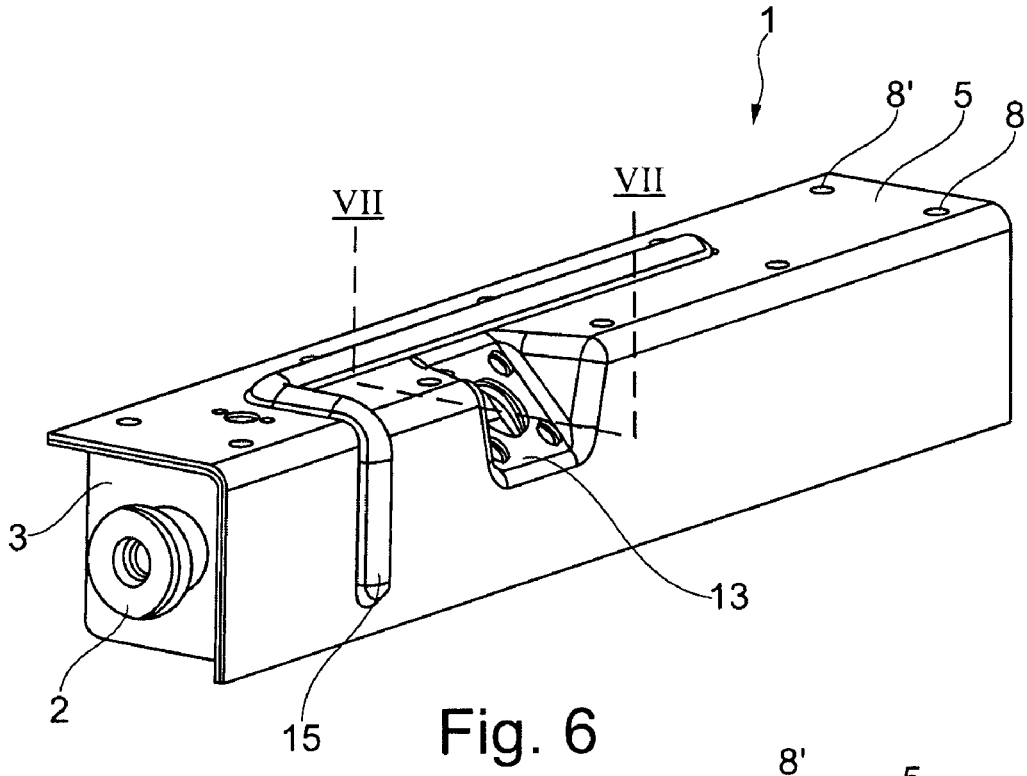
Figure 7:
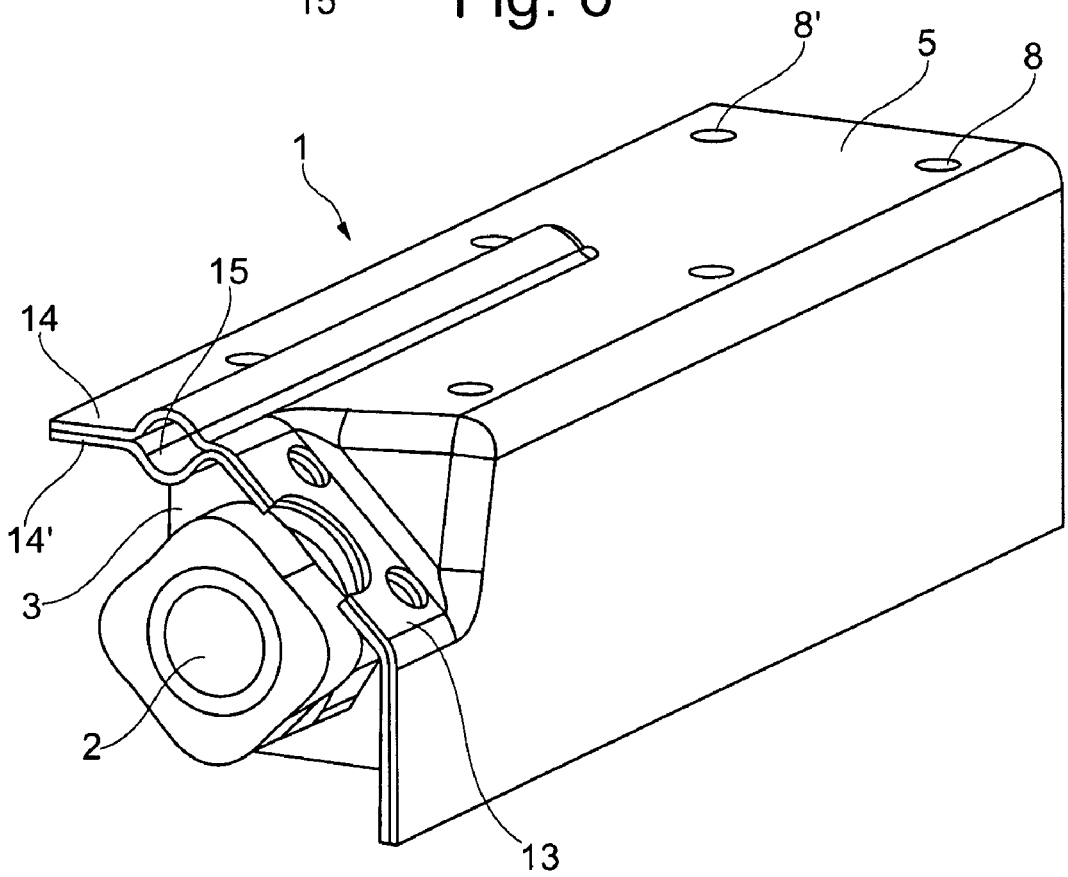
Figure 8:
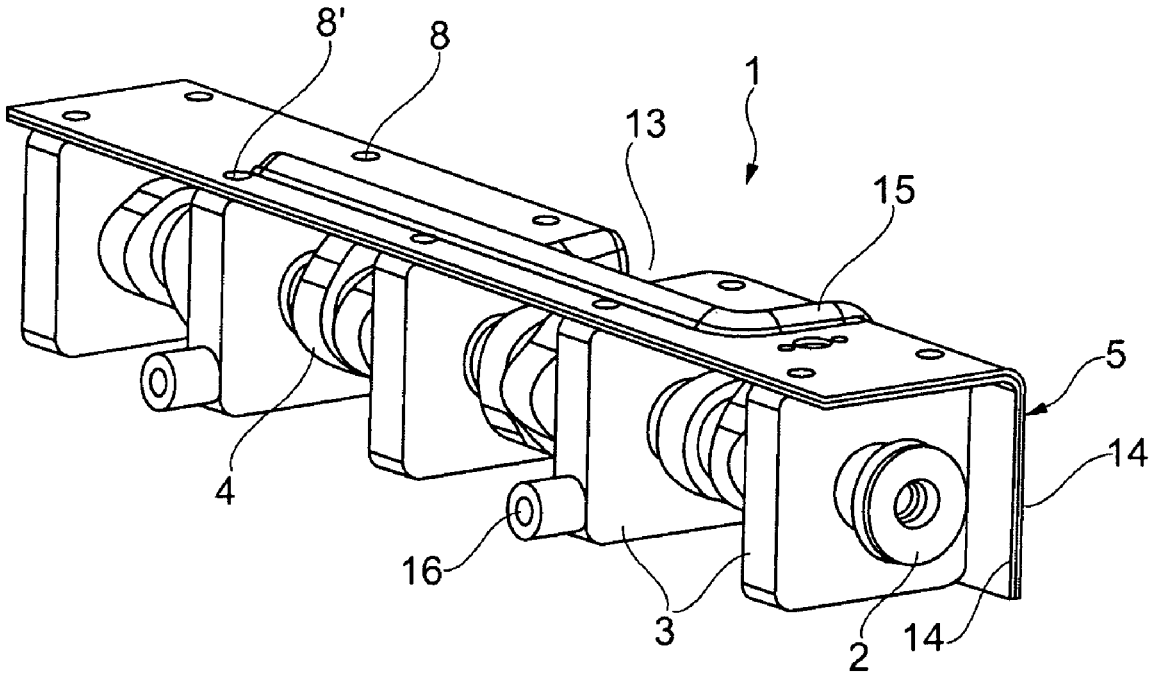

FIG. 1 shows schematically a bearing device according to the invention for supporting a camshaft, FIG. 2 shows schematically an illustration as in FIG. 1 but in a different mounting position and with the cut-outs necessary for this mounting position, FIG. 3 shows schematically a bearing device with a clipable U-shaped connection element, FIG. 4 shows a bearing device with a mounting recess/console, FIG. 5 shows schematically the bearing device according to FIG. 4, viewed from underneath, FIG. 6 shows schematically a bearing device with a L-shaped connection element, FIG. 7 shows schematically a sectional view along the section plane VII-VII of FIG. 6, FIG. 8 shows schematically an illustration as in FIG. 6, but from a different perspective.

According to FIG. 1, a bearing device 1 for supporting a camshaft 2 in a cylinder head, which is not shown here, comprises at least two bearing blocks 3 supporting the camshaft 2, here a total of five bearing blocks 3, and a connection element 5 connecting the bearing blocks 3. The camshaft 2 penetrates here the individual bearing blocks 3 in a first through-opening 6 in axial direction so that the bearing blocks 3 are slid in addition to the cams 2 onto the camshaft 2. All bearing blocks 3 are attached to the connection element 5. The bearing blocks 3, together with the connection element 5 and the camshaft 2, form a prefabricatable, and typically indeed a prefabricated module, which can be mounted in an aligned position at the cylinder head.

The bearing blocks 3 can in general be made of metal or light metal, in particular from steel or aluminum, which likewise applies also to the connection element 5. The connection element 5 is principally dimensioned such that a relative movement of the individual bearing blocks 3 to each other is completely prevented, if possible, and thereby an initially performed alignment of the bearing blocks 3 is maintained. The bearing blocks 3 are typically connected with the connection element 5 through a welded joint, for example, through so-called tack welding points. However, a clip engagement of the bearing blocks 3 with the connection element 5 (cf. FIG. 3) is also thinkable. For the clipable variant, the bearing blocks 3 are provided with clip contours 11, which can be engaged with corresponding clip openings 12 arranged at the connection element 5. Of course, an additional welding of the connection element 5 to the bearing blocks 3 is thinkable as well.

The bearing device 1 according to the invention is fabricated by first sliding the cams 4 onto the camshaft 2 and fitting them thereon, wherein the bearing blocks 3 are arranged in a row in predefined distances on the camshaft 2. Subsequently, the bearing blocks 3 are aligned to each other or to the camshaft 2, respectively, such that the same is supported smooth-running in the individual bearing blocks 3. After aligning, the individual bearing blocks 3 are fixed at the connection element 5. This prefabricated unit consisting of the connection element 5, bearing blocks 3 and camshaft 2 is then fastened, in particular screwed, in a subsequent assembly process at the cylinder head, wherein a repeated alignment of the individual bearing blocks 3 or the camshaft 2, respectively, can be eliminated, and the assembly process is made considerably simpler.

For fastening the bearing device 1 at the cylinder head, according to FIG. 1, each of the bearing blocks 3 comprises second through-openings 7 and 7', which run transverse to the first through-opening 6 for the camshaft 2, and which are aligned with a third through-opening 8 arranged in the connection element 5, and which is formed for passing through screws for fixing the bearing device 1, and hence the camshaft 2, at the cylinder head. This provides the particular advantage that the respective bearing block 3 can be screwed, together with the camshaft 2 and the connection element 5, as a unit to the cylinder head, whereby a separate and complicated fastening of the individual bearing blocks 3, which, for example, still consist of a bottom bearing shell and a top bearing shell, can be eliminated. In particular, it is possible by means of the bearing device 1 according to the invention to completely prefabricate the component complex illustrated in FIG. 1 and to provide it as a prefabricated module for the final assembly, whereby the assembly process is made considerably simpler.

In a further advantageous embodiment of the bearing device 1 according to the invention, it can additionally be provided that in a cylinder head cover, which is not illustrated here, a through-opening is provided which is aligned to at least one of the second/third through-openings 7, 8 running transverse to the camshaft 2, and which is formed for passing through a screw for fixing the bearing device 1 and the cylinder head cover at the cylinder head. Hereby it would be possible to fix the module illustrated according to FIG. 1 together with the cylinder head cover by means of few screws at the cylinder head.

As it is further apparent from FIG. 1, further through-openings can be provided in the connection element 5, for example a fourth through-opening 9, which is formed for receiving a component, in particular a sensor. Of course, the connection element 5 can serve here in general as holding element for further components which are mountable or fixable thereto, respectively, and for components or modules, respectively, which are not illustrated here.

In order to be able to simplify the assembly of the bearing device 1 according to the invention, at the connection element 5, locking contours 10 or locking elements, respectively, can be provided which can be engaged with complementary counter-locking contours or counter-locking elements, respectively, at the cylinder head cover, which is not illustrated here, so that the bearing device 1 is fixable in an exactly predefined position at the cylinder head cover, and can be fastened together with the same on the cylinder head.

For improvement of the support of the camshaft 2 in the individual bearing blocks 3, at least one bearing block 3 can comprise a needle bearing or a roller bearing supporting the camshaft 2. However, it is also thinkable that the camshaft 2 is supported directly in the bearing blocks 3, that is, without additional bearing ring.

The bearing device 1 illustrated according to FIGS. 1 and 2 can principally be fastened or arranged, respectively, at the cylinder head in two different positions, wherein the connection element 5, according to FIG. 2, can be arranged underneath, and hence between the cylinder head and the bearing blocks 3, or, as illustrated in FIG. 1, on a side of the bearing blocks 3 facing away from the cylinder head. In an arrangement as illustrated in FIG. 2, adequate through-openings are to be provided in the connection element to ensure an effective connection between the camshaft 2 and a not-illustrated valve train, for example so-called rocker arms.

The possibility mentioned in the preceding paragraphs of a clip engagement between the bearing blocks 3 and the associated connection element 5 can be carried out here with plate-type connection elements, as illustrated in FIGS. 1 and 2, as well as with L- or U-shaped connecting elements 5, as illustrated, for example, in FIGS. 3 to 8. In case of a U-shaped connection element 5, the same preferably rests against three adjoining sides at the bearing block 3, and, based on this fact alone, provides a reliable fixation of the bearing blocks 3. At the same time, a L- or U-shaped connection element 5 comprises a considerably higher section modulus, in particular a higher bending moment, whereby the bearing device 1 consisting of the camshaft 2, bearing blocks 3, and connection element 5 can be additionally stiffened. A U-shaped connection element 5 is illustrated, for example, also in FIGS. 4 and 5, wherein in this variant each of the bearing blocks 3 comprise two second through-openings 7 and 7' which penetrate the same, and which are aligned with corresponding through-openings 8 and 8', and are arranged in the connection element 5 so that the connection element 5 together with the respective bearing block 3 can be fastened at the cylinder head.

As it is further apparent from FIG. 4, at the connection element 5, in addition, a holding console 13 can be provided, by means of which further functional components, in particular a valve, or a switching element for a selective switching-off of the cylinder, are mountable.

In the FIGS. 6 to 8, a L-shaped connection element 5 is illustrated which rests against two adjacent sides of each bearing block 3, and which is connected via these contact surfaces with the respective bearing block 3. As is in particular apparent from the section view according to FIG. 7, the connection element 5 can be structured multi-layered, here double-layered, wherein a hollow space 15 formed between the individual layers 14 and 14' of the connection element 5 can serve as a lubrication channel or as a channel for running electrical lines. Of course, such a channel 15 formed by a plurality of layers 14 and 14' of the connection element 5 is also thinkable for a U-shaped or plate-shaped connection element 5. For a connection element 5 structured with more than two layers 14 and 14', a further, extremely flexible channel formation is thinkable.

In particular in case of a L-shaped connection element 5, as illustrated in FIG. 8, in addition, at the individual bearing blocks 3, further functional components 16 can be arranged, which, for example, serve for a selective switching-off of the cylinder. As is apparent from FIG. 8, the corners of the individual bearing blocks 3 are formed rounded so that a corner region, which is rounded as well, of the connection element 5, can abut against it.

By means of the bearing device 1 according to the invention, consisting of the camshaft 2, the bearing blocks 3, and the connection element 5, a prefabrication of the same can be achieved, which simplifies considerably the assembly of this prefabricated bearing device 1 at the cylinder head, and, in particular, makes a separate aligning of the camshaft 2, bearing blocks 3, and the cylinder head during assembly unnecessary.

The invention claimed is:

1. A bearing device for supporting a camshaft in a cylinder head, comprising;

at least two bearing blocks each cooperating with one another to define a first through opening, where the at least two bearing blocks support the camshaft and are axially penetrated by the camshaft by the first through-opening, a connection element, to which the at least two bearing blocks are fastened in an aligned position, wherein the connection element includes at least two layers, wherein a hollow space formed between the at least two layers serves as one of a lubrication channel and a channel for electrical lines, and wherein the bearing blocks together with the connection element and the camshaft form a prefabricatable module which is mountable in an aligned position at the cylinder head.

2. The bearing device according to claim 1, wherein the connection element is a generally planar plate configured with a plurality of apertures.

3. The bearing device according to claim 1, wherein the connection element is formed as one of L- and U-shaped, and is one of connected with at least two sides of each bearing block and rests against at least two sides of each bearing block.

4. The bearing device according to claim 1, wherein at least one of the bearing blocks is constructed from a metal based material and the connection element is constructed from a metal based material, and the connection element is welded to the bearing blocks.

5. The bearing device according to claim 4, wherein the metal based material is one of steel and aluminum.

6. The bearing device according to claim 1, wherein at least one second through-opening is configured on at least one bearing block, the opening runs transverse to the first through-opening for the camshaft, and which is aligned with a third through-opening arranged in the connection element, and which is formed for passing through a screw for fixing the bearing device and the camshaft at the cylinder head.

7. The bearing device according to claim 1, wherein the connection element includes at least one of a fourth through-opening, a recess, and a console for receiving a component.

8. The bearing device according to claim 7, wherein the fourth through-opening, the recess, and the console which is selected is configured for receiving a sensor.

9. The bearing device according to claim 1, wherein the connection element at least one of locking elements and locking contours are provided such that the bearing device together with the camshaft are fixable at a cylinder head cover.

10. The bearing device according to claim 1, wherein at least one bearing block comprises one of a needle bearing and a roller bearing supporting the camshaft.

11. The bearing device according to claim 1, wherein at least one functional component is one of integrated and mounted to the at least one bearing block.

12. The bearing device according to claim 1, wherein the connection element is at least one of arranged between the cylinder head and the bearing blocks, and arranged on a side of the bearing block facing away from the cylinder head, and wherein the connection element is a generally planar plate.

13. The bearing device according to claim 1, wherein at least one of the bearing blocks are constructed from a metal based material and the connection element is in clip engagement with the bearing blocks.

14. The bearing device according to claim 13, wherein the metal based material is one of steel and aluminum.

15. The bearing device according to claim 1, wherein the camshaft is supported directly in at least one bearing block such that a bearing ring is not needed.

16. The bearing device according to claim 15, wherein the at least one functional component is one of a valve and a switching element for the selective switching-off of a cylinder.

17. The bearing device according to claim 1, wherein at least one functional component is one of integrated and mounted at one bearing block.

18. The bearing device according to claim 1, wherein the bearing device is part of an internal combustion engine.

* * * * *